United States Patent [19]

Hiraoka

[11] Patent Number: 4,722,422

[45] Date of Patent: Feb. 2, 1988

[54] EMERGENCY ESCAPE APPARATUS

[76] Inventor: Kunizo Hiraoka, 202-5, Higashionari-cho 2-chome, Omiya-shi, Saitama, Japan

[21] Appl. No.: 835,807

[22] Filed: Mar. 3, 1986

[51] Int. Cl.[4] ..... A62B 1/12

[52] U.S. Cl. ..... 182/233; 182/238; 182/71; 254/377

[58] Field of Search ..... 182/231–240, 182/71; 188/322.5, 290, 296, 293; 254/267, 377; 242/99

[56] References Cited

U.S. PATENT DOCUMENTS

| | | | |
|---|---|---|---|
| 1,985,889 | 1/1935 | Mater | 188/296 |
| 2,421,056 | 5/1947 | Dake | 188/296 |
| 3,537,264 | 11/1970 | Nagel | 188/296 |
| 3,907,256 | 9/1975 | Kankkunen | 182/238 |
| 4,067,545 | 1/1978 | Singer | 254/377 |
| 4,301,892 | 11/1981 | Arce | 182/233 |
| 4,416,430 | 11/1983 | Totten | 182/237 |
| 4,437,546 | 3/1984 | Marinoff | 182/5 |
| 4,469,196 | 9/1984 | Sadler | 182/231 |

FOREIGN PATENT DOCUMENTS

| | | | |
|---|---|---|---|
| 570173 | 12/1975 | Switzerland | 182/240 |
| 711610 | 2/1924 | United Kingdom | 254/377 |

*Primary Examiner*—Reinaldo P. Machado
*Assistant Examiner*—A. Chin-Shue
*Attorney, Agent, or Firm*—Wenderoth, Lind & Ponack

[57] ABSTRACT

An emergency escape apparatus allows safe escape from a tall building on fire. It includes a case carried by a user on his back. A wire wound around a reel mounted in the case has one end secured to the case. With the other end of the wire secured to the building, the user jumps down. The wire is drawn out of the case, and a brake device in the case applies a braking force to the wire, allowing the user land softly.

2 Claims, 7 Drawing Figures

EMERGENCY ESCAPE APPARATUS

BACKGROUND OF THE INVENTION

The present invention relates to an emergency escape apparatus for facilitating escape from a multistoried building in which a fire has started.

With an increase in multistoried buildings, various apparatuses for meeting emergency situations have been proposed. However, none of them can be used in a simple and easy way, nor can they assure complete security of a user's life. The appearance of a highly serviceable apparatus of this kind is expected.

SUMMARY OF THE INVENTION

It is an object of the present invention to provide an emergency escape apparatus for permitting a rapid and safe escape from a high place.

In accordance with the present invention, a case adapted to be carried by a user on his back accommodates a reel, a wire of high tensile strength wound a the reel and adapted to be drawn out through an outlet provided in the upper part of the case, a braking device, and a multiplying gear through which the rotation of the reel is transmitted to the braking device.

In case of emergency, the end of the wire is secured to a building. The wire is drawn out from the case as a person carrying the case on his back goes down. The speed of revolution of the reel, hence the lowering speed of the person, is limited by the braking power applied by the braking device so as to permit a soft landing of the person.

With the above-described object in view and as will become apparent from the following detailed description, the present invention will be more clearly understood in connection with the accompanying drawings.

DETAILED DESCRIPTION OF THE INVENTION

Figure 1:
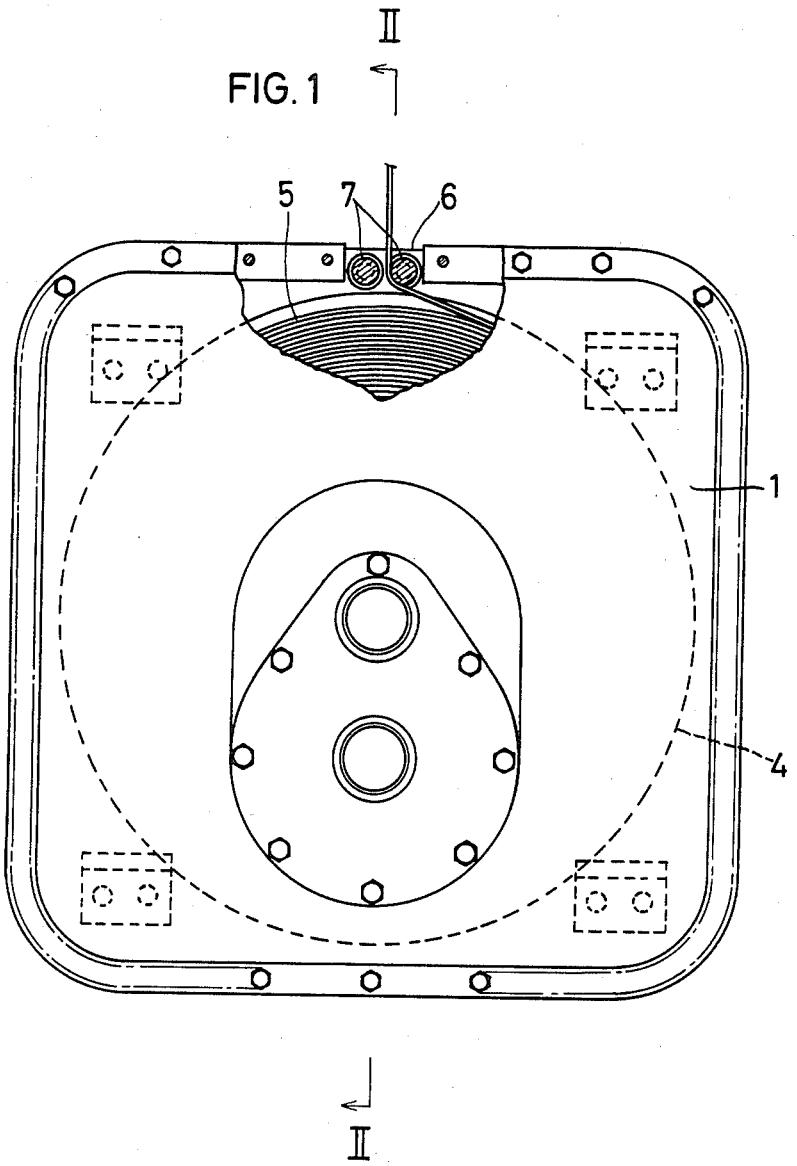
FIG. 1 is a partially cutaway front view of an apparatus according to the present invention.
Figure 2:
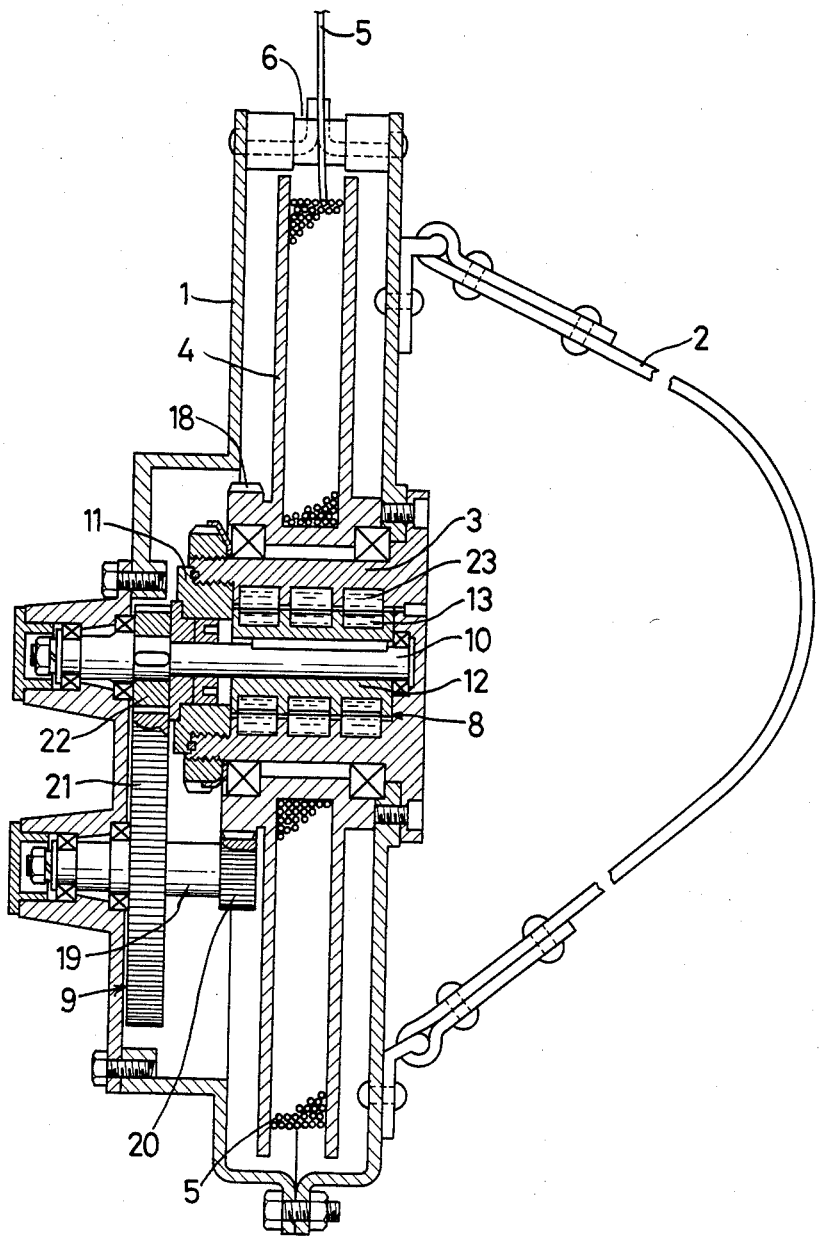
FIG. 2 is a sectional view taken along line II—II of FIG. 1.

Referring now to FIGS. 1 and 2, an apparatus in accordance with the present invention includes a hollow, flat and square-shaped case 1 adapted to be supported on the back of a person by a pair of stout straps 2 attached to one side of the case, a hub 3 bolted to the central part of one side wall of the case 1, a reel 4 mounted on the hub 3 through bearings and adapted to revolve within the case, a wire 5 wound round the reel 4 with one end thereof secured to the reel 4 and with the other end adapted to be drawn out through an outlet 6 provided in the upper part of the case 1 so as to be secured to a building, and a pair of guide rollers 7 provided at the outlet 6 for guiding the wire 5.

The wire 5 should be strong enough to support the weight of a human body, such as a piano wire having a diameter of 2.5 mm. The length of the wire 5 should be conformed to the height of the building for which the apparatus in accordance with the present invention is used. Since the reel 4 shown in FIGS. 1 and 2 is intended for use in a multistoried building, the diameter of its flanges is large enough to allow a wire 5 having a length up to 300 meters to be wound round the reel 4.

A braking device 8 for applying a braking power to the reel 4 is accommodated in the hub 3. The reel 4 is interlocked with the braking device 8 through a multiplying gear 9.

Figure 3:
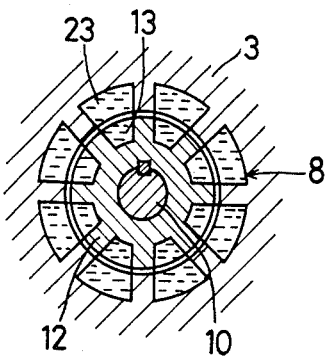
FIG. 3 is an enlarged sectional view of an example of a braking device of the present invention

An example of the braking device 8 is shown in FIGS. 2 and 3 and takes the form of a torque converter (fluid coupling), which includes a rotary shaft 10 disposed concentrically with the hub 3 and rotatably supported by the case 1, an axially bored, externally threaded cap 11 fitting over the shaft 10 so as to cover an opening of the hub 3, and a vane wheel 12 secured to the shaft 10. The vane wheel 12 is formed with a plurality of recesses 13 in its external surface. Each recess 13 is adapted to face one of a plurality of recesses 23 formed in the internal surface of the hub 3. The recesses 13 and 23, as well as the space between the hub 3 and the vane wheel 12, are filled with oil. This oil becomes more and more viscous with an increase in the speed of revolution of the vane wheel 12, which revolves together with the rotary shaft 10 during use. The viscous oil develops a resistance force against the revolution of the vane wheel 12. The magnitude of the resistance force, hence the magnitude of braking power, is in proportion to the speed of revolution of the vane wheel 12.

The reel 4 is revolved by the wire 5 drawn out from the case 1 as a person carrying the case 1 on his back goes down from a high place of a building. As will be described later, the revolution of the reel 4 is transmitted to the braking device 8 and restrained thereby. The person can go down at a nearly constant speed regardless of his weight, because the braking device 8 develops a braking power in proportion to the weight of the person.

Figure 4:
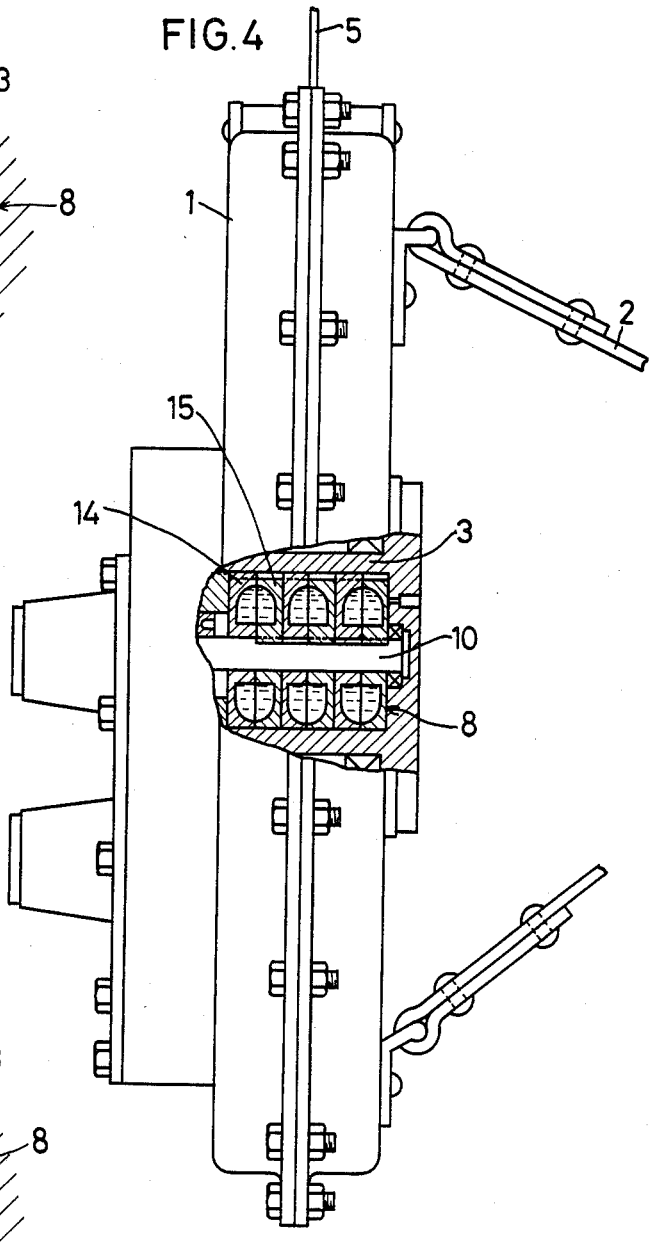
FIG. 4 is a partially cutaway side view of another example a breaking device of the present invention.
Figure 5:
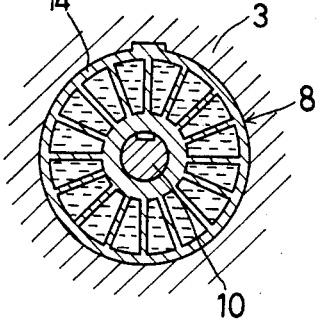
FIG. 5 is an enlarged sectional view.

Another example of the braking device 8 is shown in FIGS. 4 and 5 and also takes the form of a fluid coupling, which includes a plurality of fixed vanes 14 mounted on the internal surface of the hub 3 and a plurality of rotary vanes 15 mounted on the shaft 10 so as to alternate with the fixed vanes 14. A plurality of recesses formed in a side face of each vane 14 are adapted to face a plurality of recesses formed in a side face of each vane 15. These recesses are filled with oil so as to develop a braking power.

Figure 6:
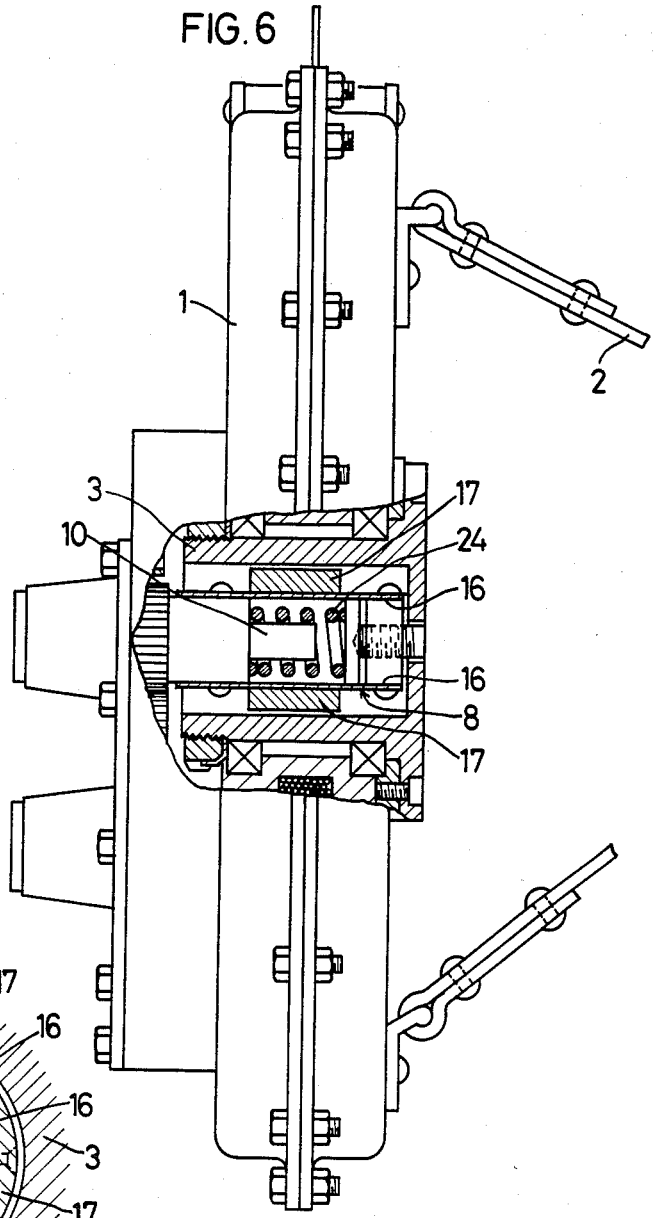
FIG. 6 is a partially cutaway side view of still another example of a braking device of the present invention.
Figure 7:
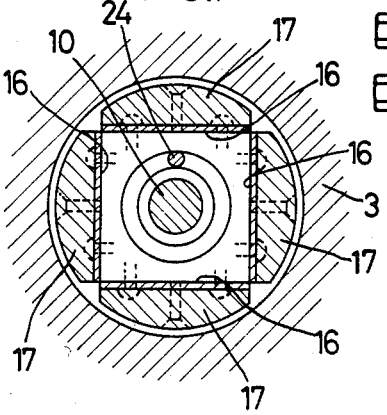
FIG. 7 is an enlarged sectional view thereof.

Still another example of the braking device 8 shown in FIGS. 6 and 7 takes the form of a mechanical governor, which includes a spring 24 fitted over the rotary shaft 10, a plurality of plates 16 fitted over the spring 24 and normally stretched tightly in an axial direction by the tension of the spring 24, and a friction shoe 17 secured to the external surface of each plate 16 and normally kept apart from the inner surface of the hub 3. When the shaft 10 rotates, the plates 16 are bulged by the centrifugal force against the tension of the spring 24. Consequently, the friction shoes 17 will engage the inner surface of the hub 3 and thereby develop a braking power, by which the speed at which the person goes down is controlled so as to be kept at a nearly constant value.

A steel strip may be used in place of the piano wire 5.

The multiplying gear 9 (FIG. 2) includes a gear 18 provided on the reel 4, a pinion 20 provided on one end of a countershaft 19 and engaging the gear 18, a gear 21 provided on the other end of the countershaft 19, and a pinion 22 provided on the rotary shaft 10 and engaging the gear 21.

It is recommended that a plurality of cases 1 should be made ready for use at an emergency exit to the rooftop of a multistoried building, with the wire 5 slightly drawn out from each case 1 and with the end of the wire 5 secured to the building.

When a fire starts in the building, each person has to only secure the case 1 on his back and jump down to the earth below. The wire 5 is drawn out from the case 1 as the person carrying the case 1 on his back goes down. The revolution of the reel 4 is transmitted to the braking device 8, which develops a braking power in proportion to the weight of the person so as to permit a soft landing of the person.

Thus the apparatus in accordance with the present invention allows a person to escape from a multistoried building without fear, because the braking device 8 develops a braking power in proportion to the weight of the person and consequently he can go down at a nearly constant speed regardless of his weight.

Furthermore, the apparatus in accordance with the present invention can be easily carried by a person on his back so as to permit rapid escape in case of emergency.

What I claim:

1. An emergency escape apparatus worn by a user for escaping from a high place, said apparatus comprising:

a case and attaching means for securing said case on the back of the user, said case having a wire outlet opening extending therethrough;

a cylindrical hub fixed within said case, the inner cylindrical surface of said hub having an oil-filled recess extending therein;

a cylindrical wheel extending within said cylindrical hub, the outer peripheral surface of said wheel having an oil-filled recess extending therein opposing and open to the oil-filled recess extending in said inner cylindrical surface;

a reel rotatably mounted on said hub within said case;

a wire wrapped around said reel, said wire extending through said wire outlet opening and having one end secured to said reel and the other end securable to the high place, whereby when said case is secured on the back of the user by said attaching means, when said other end of said wire is secured to the high place and when the user jumps from the high place, said reel rotates and said wire unwraps around said reel thereby lowering the user;

fluid brake means defined within said case for braking said rotation of said reel to a substantially constant rotational speed, said fluid brake means including said inner cylindrical surface of said hub and said outer peripheral surface of said cylindrical wheel, said outer peripheral surface being rotatable relative to said inner cylindrical surface; and transmission means connected between said reel and said second surface for transmitting said rotation of said reel to said second surface to rotate said outer peripheral surface relative to said inner cylindrical surface to actuate said fluid brake means to brake the rotation of said reel via said transmission means to said substantially constant rotational speed.

2. An emergency apparatus to be worn by a user for escaping from a high place, said apparatus comprising:

a case and attaching means for securing said case on the back of the user, said case having a wire outlet opening extending therethrough;

a cylindrical hub fixed within said case;

a reel rotatably mounted on said hub within said case;

a wire wrapped around said reel, said wire extending through said wire outlet opening and having one end secured to said reel and the other end securable to the high place, whereby when said case is secured on the back of the user by said attaching means, when said other end of said wire is secured to the high place and when the user jumps from the high place, said reel rotates and the wire unwraps around said reel thereby lowering the user;

brake means disposed within said cylindrical hub for braking said rotation of said reel to a substantially constant rotational speed, said brake means comprising a first surface, a second surface opposed to and in braking relationship with said first surface, said second surface being rotatable relative to said first surface; and transmission means connected between said reel and said second surface for transmitting said rotation of said reel to said second surface to rotate said second surface relative to said first surface.

* * * * *